US007934443B1

(12) United States Patent
Bennett

(10) Patent No.: US 7,934,443 B1
(45) Date of Patent: May 3, 2011

(54) MAGAZINE FOR 22 CALIBER CONVERSION KIT AND 22 CALIBER FIREARM

(76) Inventor: Keith A. Bennett, Falls Mills, VA (US)

( * ) Notice: Subject to any disclaimer, the term of this patent is extended or adjusted under 35 U.S.C. 154(b) by 455 days.

(21) Appl. No.: 12/098,200

(22) Filed: Apr. 4, 2008

Related U.S. Application Data

(60) Provisional application No. 60/921,979, filed on Apr. 5, 2007.

(51) Int. Cl.
*F41A 9/29* (2006.01)

(52) U.S. Cl. ..... 89/33.14; 42/49.01

(58) Field of Classification Search ..... 89/33.14, 89/33.16, 33.25, 33.5, 35.01, 35.02, 33.1, 89/33.02, 197, 195, 33.17, 33.2; 42/11, 17, 42/18, 19, 21, 29, 49.01
See application file for complete search history.

(56) References Cited

U.S. PATENT DOCUMENTS

| | | | | | |
|---|---|---|---|---|---|
| 386,535 | A | * | 7/1888 | Graham | 42/39.5 |
| 1,314,013 | A | * | 8/1919 | Mulvey | 42/19 |
| 1,412,287 | A | * | 4/1922 | Kovaleff | 89/33.14 |
| 1,436,232 | A | * | 11/1922 | Bohnak | 89/33.16 |
| 2,114,311 | A | * | 4/1938 | Louis | 42/49.01 |
| 2,569,798 | A | * | 10/1951 | Carroll | 89/33.14 |
| 2,873,649 | A | * | 2/1959 | Maillard | 89/33.25 |
| 2,936,677 | A | * | 5/1960 | Vickers | 89/33.16 |
| 3,143,038 | A | * | 8/1964 | Hans | 89/33.5 |
| 3,507,186 | A | * | 4/1970 | Cermak et al. | 89/34 |
| 3,650,175 | A | * | 3/1972 | Colby | 89/33.25 |
| 3,955,469 | A | | 5/1976 | Conley | |
| 3,985,060 | A | | 10/1976 | Conley | |
| 4,112,817 | A | | 9/1978 | Bourlet | |
| 4,468,875 | A | * | 9/1984 | Harrison et al. | 42/50 |
| 4,524,673 | A | * | 6/1985 | Golden | 89/33.02 |
| 4,676,138 | A | * | 6/1987 | Thompson et al. | 89/33.14 |
| 4,686,887 | A | | 8/1987 | Schiele | |
| 4,930,400 | A | * | 6/1990 | Brandl et al. | 89/34 |
| 4,938,116 | A | * | 7/1990 | Royster | 89/198 |
| 4,942,802 | A | * | 7/1990 | Stoner | 89/191.01 |
| 5,295,320 | A | * | 3/1994 | Svensson | 42/49.01 |
| 5,353,679 | A | | 10/1994 | Nordmann | |
| 5,782,157 | A | | 7/1998 | Ellington et al. | |
| 6,634,274 | B1 | | 10/2003 | Herring | |
| 6,681,677 | B2 | | 1/2004 | Herring | |
| 2004/0200111 | A1 | | 10/2004 | Horn | |
| 2005/0081707 | A1 | * | 4/2005 | Herring | 89/33.14 |

* cited by examiner

*Primary Examiner* — Benjamin P Lee
(74) *Attorney, Agent, or Firm* — Christopher C. Dremann, P.C.

(57) ABSTRACT

A magazine configured for use with a 22 caliber conversion kit and/or a non-converted 22 caliber firearm includes an elongate, hollow, rectangular housing for receiving an ammunition belt on a splined belt pulley. A slide of the firearm applies an impact force to a strike wheel to pivot a cam against a spring-loaded rack. The rack moves downward and causes a rack gear to rotate a drive gear freely in the slip direction of a unidirectional bearing. When the impact force is removed, the spring-loaded rack returns upward under the biasing force of the spring causing the rack gear to rotate the drive gear on the unidirectional bearing in the drive direction. The drive gear turns a drive axle, which turns the splined belt pulley to advance the ammunition belt sufficiently to position the next round of ammunition for entry into the firing chamber.

16 Claims, 13 Drawing Sheets

MAGAZINE FOR 22 CALIBER CONVERSION KIT AND 22 CALIBER FIREARM

CROSS REFERENCE TO RELATED APPLICATION

This application claims the benefit of priority of U.S. Provisional Application No. 60/921,979, filed on Apr. 5, 2007.

BACKGROUND OF THE INVENTION

1. Field of the Invention

The present invention relates generally to a magazine for feeding 22 caliber ammunition to a firearm. More specifically, the invention is a belt-fed magazine for a 22 caliber conversion kit or a non-converted 22 caliber firearm.

2. Description of the Related Art

Conversion kits for converting a large caliber handgun, rifle or submachine gun, collectively referred to herein as a "large caliber firearm," into a 22 caliber firearm are known. Examples include the Ciener .22LR (Long Rifle) Conversion Kits available from Jonathon Arthur Ciener, Inc., of Cape Canaveral, Fla., USA, that readily reconfigure a large caliber firearm for .22 rim fire cartridge semi-automatic blowback operation. Specific Ciener Conversion Kits have been developed for a 9 mm or 0.40 S&W caliber Glock® handgun; a gas-operated 5.56 mm or .223 REM center-fire AR-15 or M-16 rifle; and a Thompson® submachine gun. In all cases, conversion to the smaller caliber allows the user to reduce the cost of operation by taking advantage of less expensive .22LR ammunition for target practice and recreational shooting, commonly referred to as "plinking." A 22 caliber conversion kit also permits a firearm enthusiast to utilize an indoor firing range where use of a larger caliber firearm is prohibited due to overpower, noise restrictions and/or safety concerns. Smaller caliber ammunition is also less intimidating for novice enthusiasts and is less destructive to targets and the surrounding environment.

A typical 22 caliber conversion kit for a handgun includes a .22LR barrel, a slide and an ammunition magazine. The magazine is an essentially hollow, elongate, generally rectangular tube with an open end for loading the ammunition and delivering the ammunition to the firing chamber of the firearm. One of the problems associated with 22 caliber conversion kits, however, is that the magazine has limited capacity. Despite its limited capacity, the magazine is also time consuming and somewhat difficult to load. The magazine is loaded by pressing one round of ammunition at a time into the open end of the tube against the biasing force of a spring. The biasing force of the spring increases as each successive round of ammunition is loaded into the magazine against the previous round. The design of the standard magazine and the corresponding loading process is prevalent among almost all semi-automatic firearms, including non-converted 22 caliber firearms, such as the Ruger® 10/22 and 77/22 manufactured by Sturm, Ruger & Co., of Southport, Conn., USA. The limited capacity and the time required to load the magazine can be overcome by using belt-fed ammunition. However, current firearms must be provided with a non-standard ammunition receiver, or fitted with a device for converting the standard receiver of a particular firearm to accept belt-fed ammunition. Presently, there is no belt-fed magazine available for a 22 caliber conversion kit or a non-converted 22 caliber firearm. Accordingly, a belt-fed magazine for a 22 caliber conversion kit and a non-converted 22 caliber firearm is needed to increase the ammunition capacity of the magazine as well as reduce the time and effort required to load the magazine. Such a magazine should be suitable for use with both 22 caliber conversion kits available for various large caliber firearms and non-converted 22 caliber firearms with no additional alteration to the firearm.

BRIEF SUMMARY OF THE INVENTION

To achieve the foregoing and other objects, and in accordance with the purposes of the invention as broadly described herein, the present invention provides a belt-fed magazine for 22 caliber conversion kits and non-converted 22 caliber firearms. In the various embodiments, the improved magazine increases the capacity of the ammunition delivered to the firearm and reduces the time required to load the magazine. In addition, the belt-fed magazine of the present invention does not require additional alteration of the firearm and is merely substituted for the .22LR magazine of the conversion kit or the standard magazine of a non-converted 22 caliber firearm. A belt-fed magazine according to the present invention includes an essentially hollow, elongate, generally rectangular housing for receiving an ammunition belt on a splined belt pulley. A slide of the firearm applies an impact force to a strike wheel to pivot a cam against a spring-loaded rack. The rack moves downward and causes a rack gear to rotate a drive gear freely in the slip direction of a unidirectional bearing. When the impact force is removed, the spring-loaded rack returns upward under the biasing force of the spring, and thereby causes the rack gear to rotate the drive gear on the unidirectional bearing in the drive direction. The drive gear turns a drive axle, which drives the splined belt pulley to advance the ammunition belt sufficiently to position the next round of ammunition for entry into the firing chamber.

BRIEF DESCRIPTION OF THE DRAWINGS

These and other features, aspects and advantages of the present invention are better understood with reference to the following detailed description of the invention and the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the embodiments set forth herein. The exemplary embodiments are provided so that this disclosure will both fully and completely convey the scope of the invention, and thereby enable one of ordinary skill in the art to make, use and practice the invention without undue experimentation. Like reference numbers refer to like elements throughout the various drawings.

The exemplary embodiments shown and described herein broadly disclose a belt-fed magazine suitable for use with a 22 caliber conversion kit for a large caliber firearm or a non-converted 22 caliber firearm. As used herein, the term "large caliber firearm" refers to a handgun, rifle or submachine gun configured for use with ammunition larger than .22LR ammunition. The term "22 caliber conversion kit" is intended to include any device suitable for readily reconfiguring a large caliber firearm to .22 rim fire cartridge blowback operation. Although specific examples of 22 caliber conversion kits for a Glock® handgun and a Ruger® rifle are shown and described herein, the invention is equally applicable to any type of 22 caliber conversion kit for any large caliber firearm, or for any non-converted 22 caliber firearm having an enlarged magazine well (also commonly referred to as a receiver). Such 22 caliber conversion kits are readily available for 1911A1, Beretta® 92/96FS, Taurus® PT92/99, Glock® 17/22 and 19/23 and Browning® handguns, Atchisson MKIII AR-15 and M-16, Hohrein Mini-14/AC556 and AK47S/AK84S rifles, and Thompson® submachine guns. Common examples of non-converted 22 caliber rifles include the Ruger® 10/22 and 77/22 models.

Figure 1:
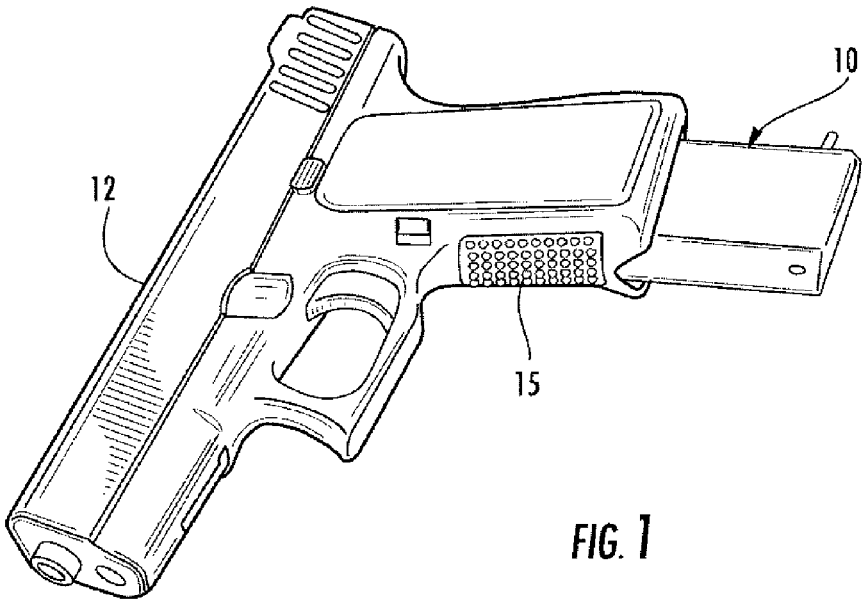
FIG. 1 is an environmental perspective view of an exemplary embodiment of a belt-fed magazine according to the present invention shown installed in a large caliber handgun.

An environmental perspective view of an exemplary embodiment of a belt-fed magazine 10 for a handgun 12 is shown in FIG. 1. The handgun 12 is preferably a large caliber firearm, such as a 9 mm Glock® manufactured by Glock, Inc. of Smyrna, Ga., USA, that has been re-configured for .22 rim fire cartridge blowback operation using a modified 22 caliber conversion kit. The frame of the handgun 12 shown herein is used in the Mech Tech Pistol-To-Carbine Conversion Unit (CCU) available from Mech Tech Systems, Inc., and the magazine 10 is used in the Kel-Tec SUB-2000 pistol-caliber rifle manufactured by Kel-Tec CNC Industries of Cocoa, Fla. The magazine 10 is shown in FIG. 1 without an ammunition belt installed for purposes of clarity. The 22 caliber conversion kit is a conventional conversion kit including a .22LR barrel, a slide, a return spring and guide rod, and a modified magazine. The magazine is modified according to the present invention to be belt-fed as opposed to a conventional spring-loaded magazine. The belt-fed magazine 10 permits relatively fast and easy loading of the magazine, as well as continuous feeding of ammunition to the firearm. As a result, the belt-fed magazine of the present invention provides increased capacity, while at the same time reducing the time and effort required to load the magazine, without requiring any additional alteration to the firearm.

Figure 2:
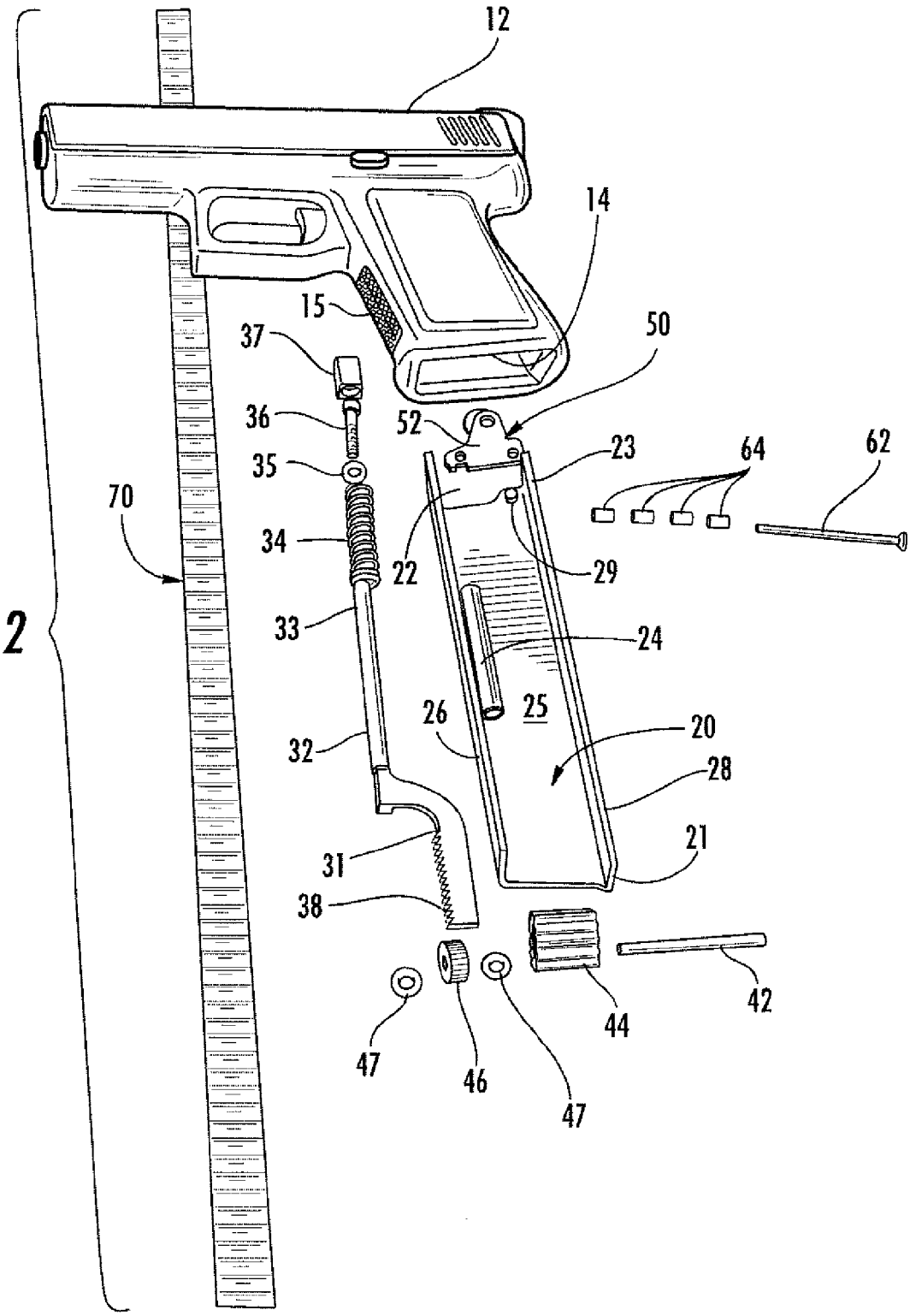
FIGS. 2-4 are exploded perspective views of the belt-fed magazine of FIG. 1 showing the magazine disassembled.
Figure 3:
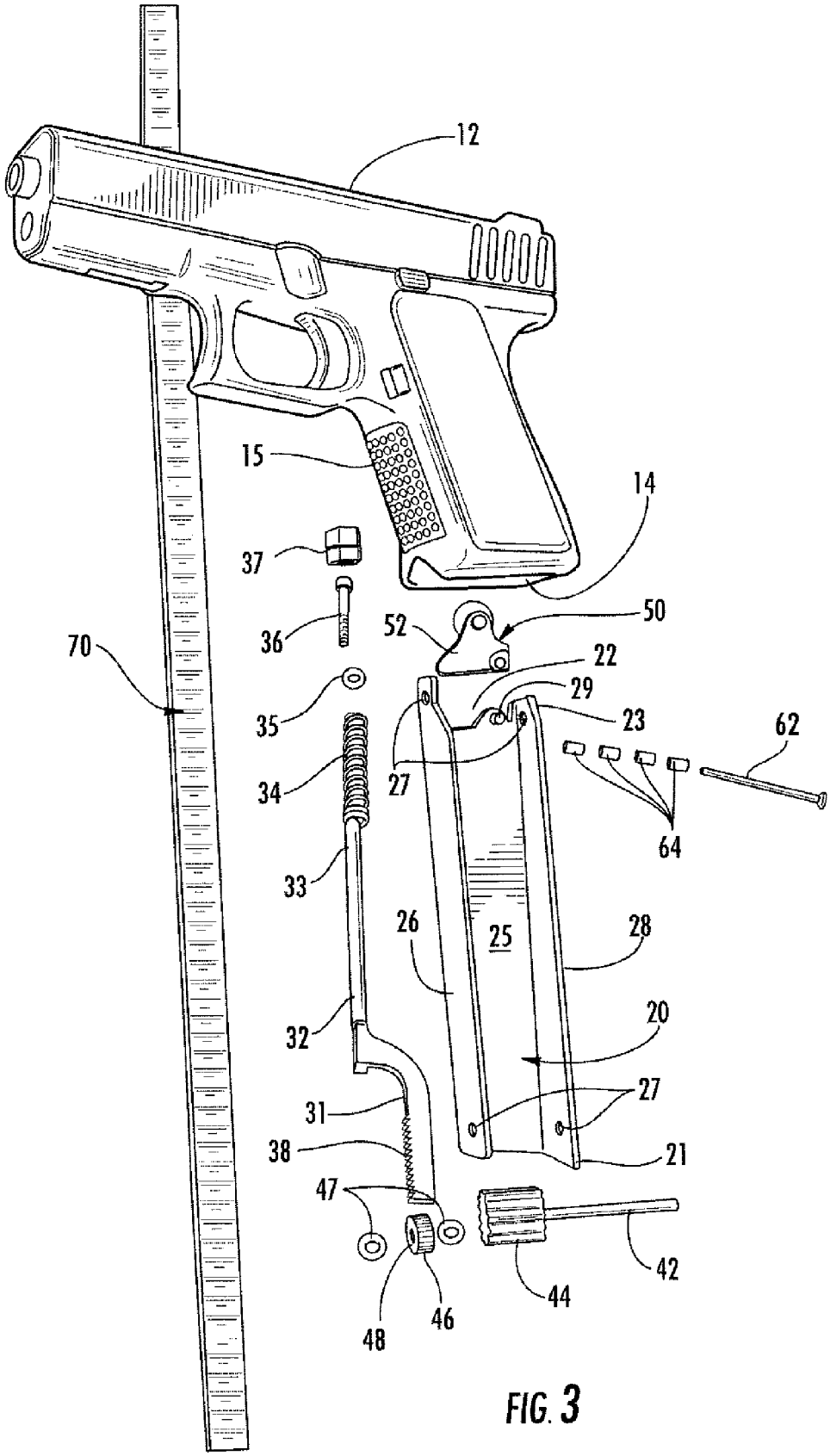
Figure 4:
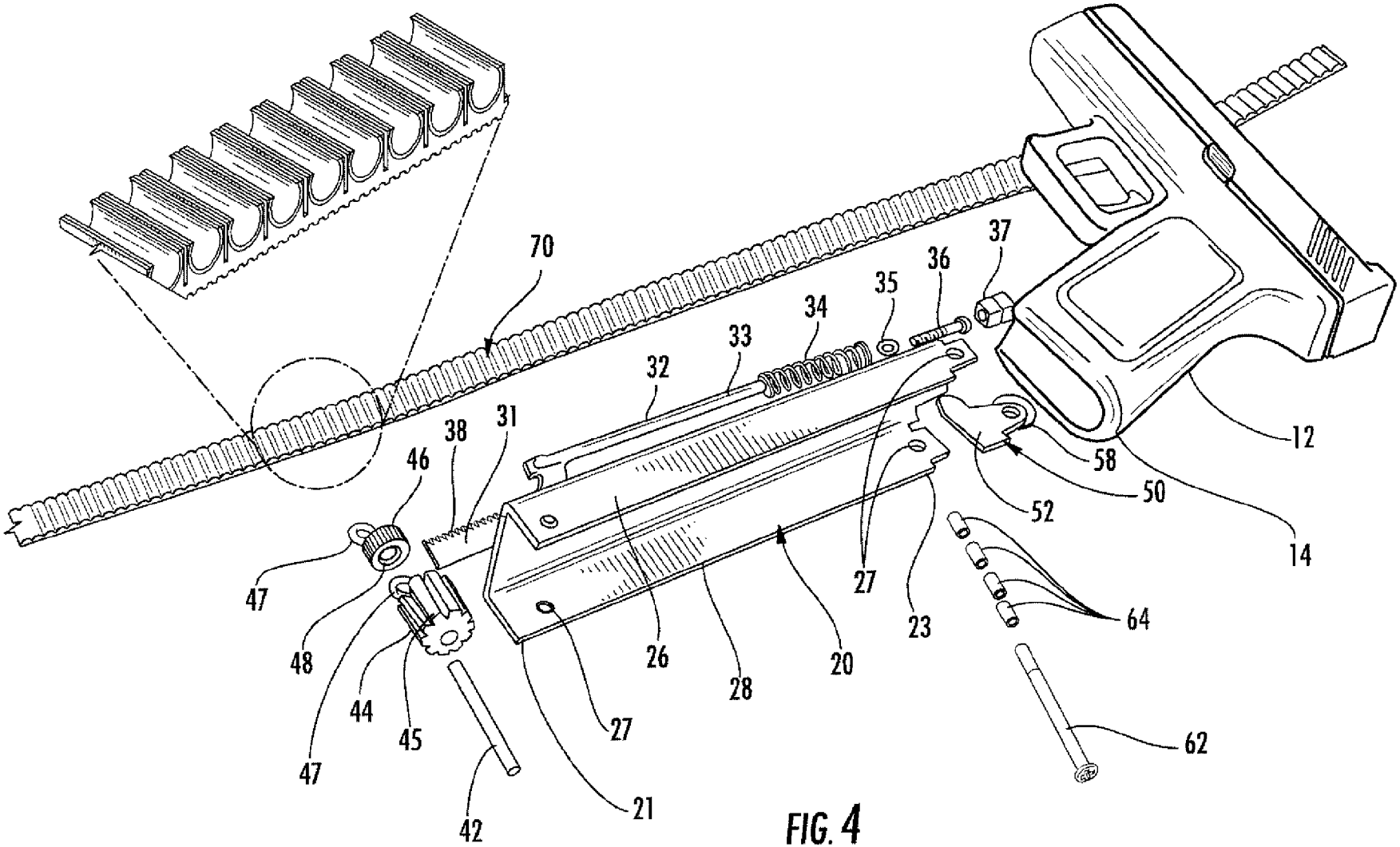
Figure 5:
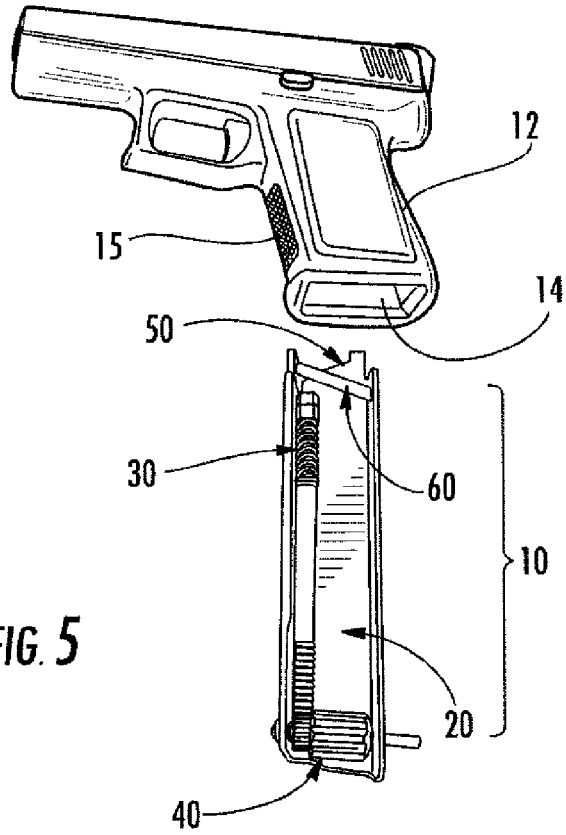
FIGS. 5-6 are perspective views of the belt-fed magazine of FIG. 1 showing the magazine assembled and with the ammunition belt removed for purposes of clarity.
Figure 6:
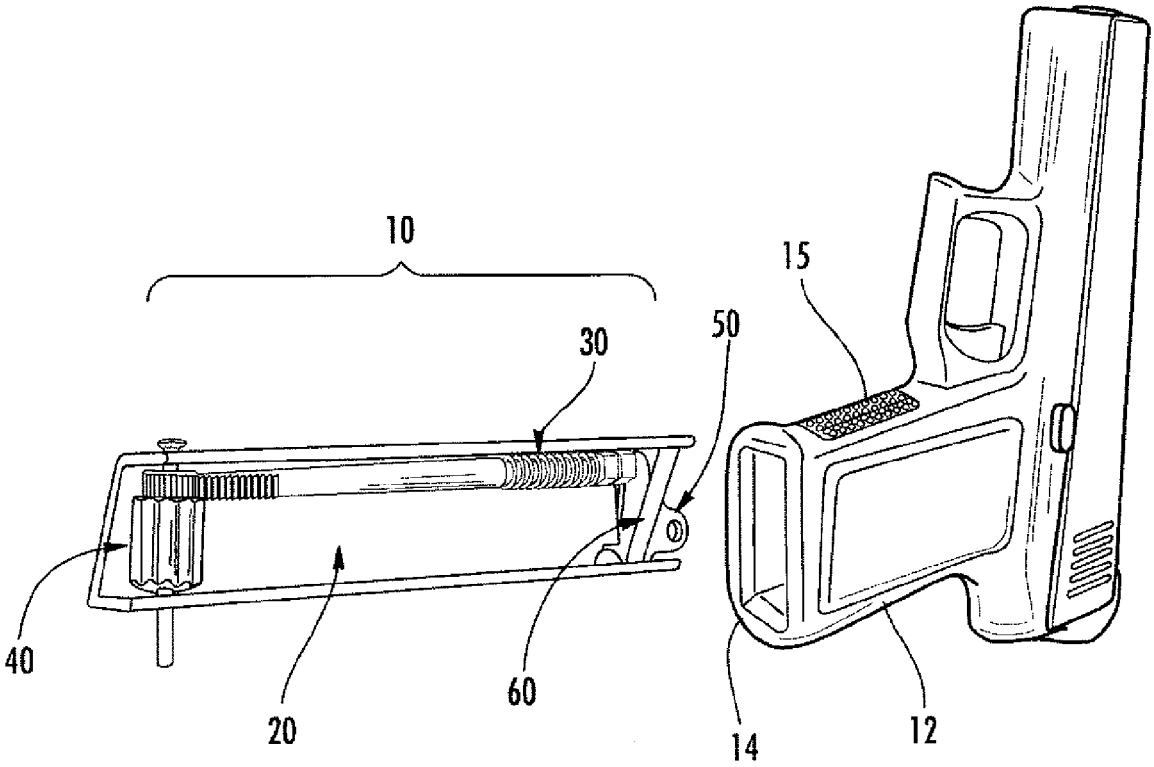
Figure 7:
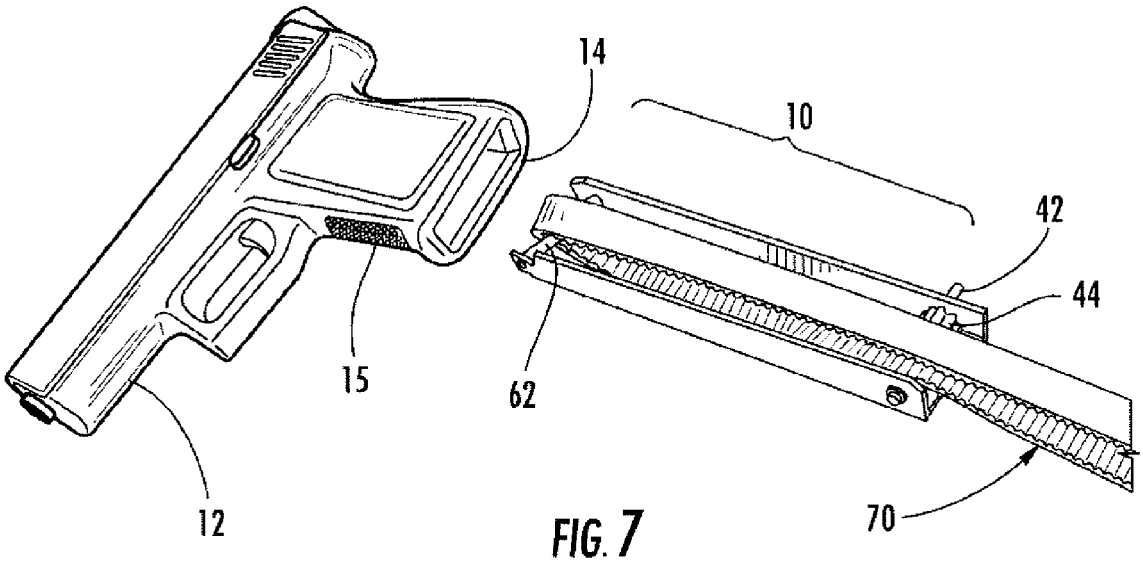
FIGS. 7-8 are perspective views of the belt-fed magazine of FIG. 1 showing the magazine fully assembled with the ammunition belt installed.
Figure 8:
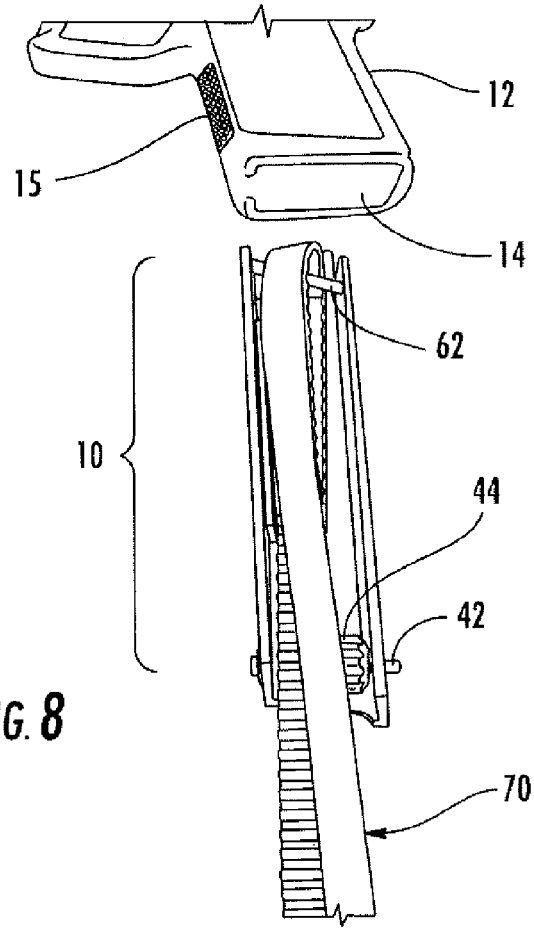

FIGS. 2-4 are exploded perspective views showing the internal components of the belt-fed magazine 10, including ammunition belt 70. FIGS. 5-6 are perspective views of the magazine 10 assembled, but without the ammunition belt 70 shown for purposes of clarity. FIGS. 7-8 are perspective views of the fully assembled magazine 10 shown with the ammunition belt 70 installed. The magazine 10 comprises a housing 20 sized to receive a rack assembly 30, a belt drive assembly 40, a strike wheel and cam assembly 50, an idler roller assembly 60 and a .22LR ammunition belt 70. Details of the housing 20, the belt drive assembly 40, the strike wheel and cam assembly 50, and the roller idler assembly 60 are shown in FIGS. 15-18, respectively.

The housing 20 is shown in most views with one of the larger walls removed to expose the internal components of the magazine 10. The housing 20 is an essentially hollow, elongate, generally rectangular tube made of a substantially rigid material, such as metal or hard plastic. The housing 20 is open at a lower end 21 and at an upper end 23 for reasons which will become apparent hereinafter. A cutout 22 may be formed adjacent the upper end 23 of the housing 20 for receiving the strike wheel and cam assembly 50. Otherwise, the housing 20 is essentially closed by conjoined walls that define a box-like cross-section. As will be discussed in greater detail below, the upper end 23 of the housing 20, including the strike wheel and cam assembly 50 and the idler roller assembly 60, is sized to be received within a recess, commonly referred to as the magazine well 14 of the handgun 12. The housing 20 comprises a rack tube 24 affixed to an inner surface 25 adjacent one of the laterally extending walls 26, 28 of the housing. As shown, the rack tube 24 is affixed to the inner surface 25 adjacent the lateral wall 26 nearest the grip 15 of the handgun 12. The rack tube 24 is a hollow, elongate tube sized to slidingly receive the upper end 33 of the rack 32 of the rack assembly 30, as will be described. The housing 20 also has openings 27 formed in the lateral walls 26, 28 for receiving the drive axle 42 of the belt drive assembly 40 and the drive axle 62 of the idler roller assembly 60. In addition, a projection, pin or stud 29 protrudes outwardly from the inner surface 25 of the housing 20 adjacent the upper end 23 to pivotally receive the cam 52 of the strike wheel and cam assembly 50.

The rack assembly 30 comprises a rack 32 having a lower end 31 and an upper end 33. As shown, the lower end 31 is generally planar and L-shaped for a purpose which will become apparent hereinafter. The upper end 33 of the rack 32 is sized to be slidingly received within the hollow rack tube 24 (FIG. 2). As shown, the upper end 33 of the rack 32 is generally round. However, the upper end 33 may have any convenient shape as long as the rack 32 slides freely upwards and downwards within the rack tube 24. The upper end 33 of the rack 32 extends upwardly beyond the rack tube 24 such that a spring 34 may be captured between the rack tube and a washer 35 disposed under the head of an externally threaded fastener 36, such as a machine screw, when the fastener engages internal threads (not shown) formed in the upper end 33 of the rack 32. When compressed from its elongated length, the spring 34 biases the rack 32 upwardly for a purpose to be described hereinafter. The fastener 36 (in conjunction with the spring 34) functions as a timing adjuster for the magazine 10, as will be discussed in greater detail below. As shown, an optional timing adjuster cap 37 is disposed between the fastener 36 and the cam 52 of the strike wheel and cam assembly 50. The timing adjuster cap 37 may be necessary to transfer a force applied by the cam 52 to the head of the fastener 36 and/or prevent the fastener from rotating and consequently tightening or loosening, thereby inadvertently adjusting the timing of the magazine 10. The rack assembly 30 further comprises a rack gear 38 that is rigidly affixed to the lower end 31 of the rack 32. The rack gear 38 is sized to mesh with a drive gear 46 of the belt drive assembly 40 in a conventional rack-and-pinion relationship, as will be described hereinafter. Depending upon the direction of advancement of the ammunition belt 70 through the housing (i.e. clockwise or counter-clockwise) required for a particular firearm, a transfer gear (not shown) might be affixed to the housing 20 and positioned between the rack gear 38 and the drive gear 46. In most instances, the transfer gear will eliminate the need for the lower end 31 of the rack 32 to be L-shaped, as previously indicated.

The belt drive assembly 40 comprises a drive axle 42, a belt pulley 44, the drive gear 46, a pair of washers 47, and a unidirectional bearing 48. The unidirectional bearing 48 is inserted into the hollow center of the drive gear 46 such that the drive gear freely rotates on the unidirectional bearing in one direction (e.g. clockwise), but transfers torque to the unidirectional bearing in the other direction (e.g. counter-clockwise). The belt pulley 44 is press fit onto the drive axle 42 as the drive axle is inserted through the openings 27 formed in the lateral walls 26, 28 of the housing 20 adjacent the lower end 21. A washer 47 is disposed between the combined unidirectional bearing 48/drive gear 46 and the lateral wall 26 of the housing 20 so that the drive gear 46 rotates freely relative to the housing. Likewise, a washer 47 is disposed between the belt pulley 44 and the lateral wall 28 of the housing 20 so that the drive axle 42 rotates freely relative to the housing. If desired, a third washer 47 may be disposed between the unidirectional bearing 48/drive gear 46 and the belt pulley 44 so that the drive gear 46 rotates freely relative to the belt pulley 44 in the one (i.e. slip) direction. The opposite ends of the drive axle 42 may be machined to be flush with the outer surfaces of the lateral walls 26, 28 of the housing 20 for aesthetic purposes as well as to prevent the magazine 10 from interfering with the user or the user's clothing. The outer surface of the belt pulley 44 is formed with a plurality of circumferential, laterally-extending splines 45 (FIG. 4) for engaging the ammunition belt 70, as will be described in greater detail hereinafter.

Figure 17:
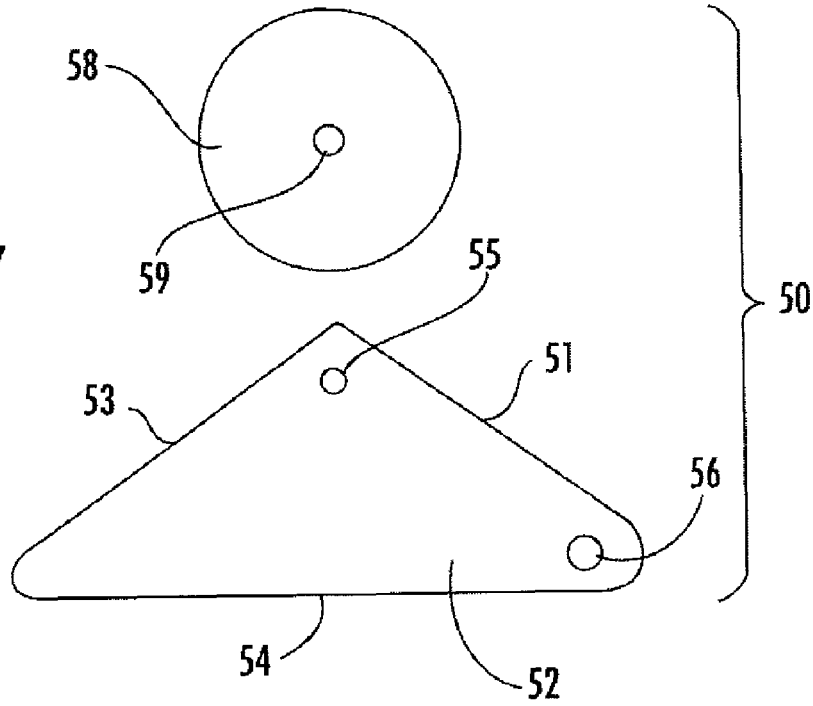
Figure 18:
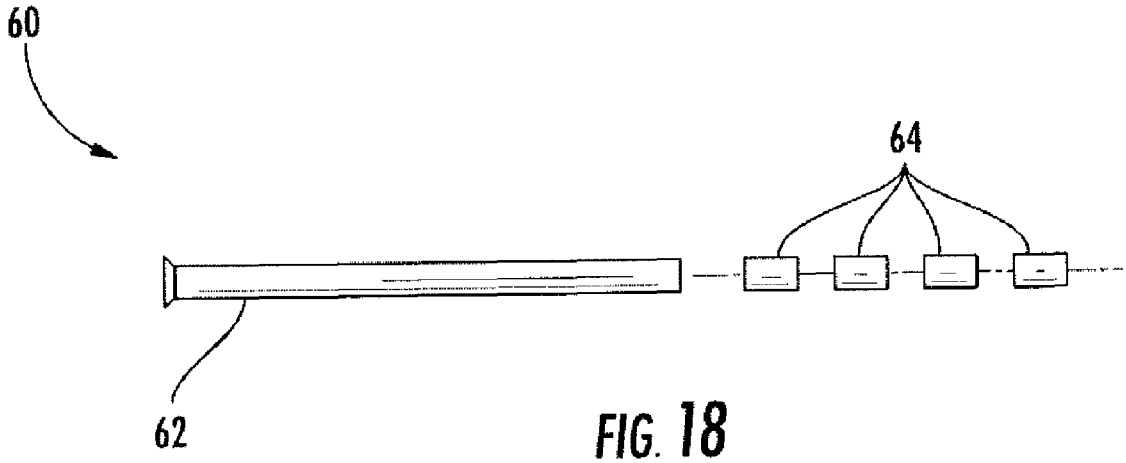

The strike wheel and cam assembly 50 comprises a cam 52 and a strike wheel 58 mounted on the cam. As best shown in FIG. 17, the cam 52 is generally triangular-shaped with two shorter sides 51, 53 of equal length and a longer side 54. The apex between the shorter sides 51, 53 may be a sharp angle. However, the apex between each of the shorter sides 51, 53 and the longer side 54 is preferably provided with a radius (i.e. rounded) for a purpose that will become apparent. One of the outer lateral surfaces of the cam 52 may be recessed to receive the strike wheel 58. The cam 52 has a small diameter first bore 55 formed therethrough at the apex between the shorter sides 51, 53, and the strike wheel 58 has a small diameter hole 59 formed through its center. A pin (not shown) is press fit into the hole 59 of the strike wheel 54 and the first bore 55 of the cam 52 such that the strike wheel is rigidly affixed to the cam 52 at the apex between the shorter sides 51, 53. Alternatively, the first bore 55 of the cam 52 may be replaced by a projection, such as a pin or stud, and the hole 59 of the strike wheel 54 may be press fit onto the stud of the cam. If desired, the cam 52 and the strike wheel 58 may be adhered or otherwise permanently secured to the pin, the stud, or to each other. The cam 52 further has a small diameter second bore 56 formed therethrough at the apex between the shorter side 53 and the longer side 54. An undersized projection, pin or stud 29 projects outwardly from the inner surface of the housing 20 and is received within the second bore 56 to pivotally attach the cam 52 to the housing with the apex between the other shorter side 51 and the longer side 54 in contact with the timing adjuster cap 37 (or the head of the fastener 36 if the timing adjuster cap is omitted). In this manner, the cam 52 pivots (i.e. rotates) relative to the housing 20 when a force having a lateral or vertical component is applied to the strike wheel 58, as will be described. Alternatively, the strike wheel 58 may be mounted directly onto the rack assembly 30 in a suitable manner.

The roller idler assembly 60 comprises an idler arm 62 and a plurality of rollers 64 rotatably disposed on the idler arm. The rollers 64 are mounted on the idler arm 62 as the idler arm is inserted through the openings 27 formed in the lateral walls 26, 28 of the housing 20 adjacent the upper end 23. The idler arm 62 may be retained within the housing 20 in any suitable manner. For example, the idler arm 62 may be spring-loaded against the lateral walls 26, 28. Alternatively, the opposite ends of the idler arm 62 may tacked (e.g. soldered) into the openings 27 of the lateral walls 26, 28 or otherwise rigidly secured, such as by a press fit. Regardless, the opposite ends of the idler arm 62 are flush with the outer surfaces of the lateral walls 26, 28 of the housing 20 so that the magazine 10 can be inserted into the magazine well 14 of the handgun 12 without obstruction. Each of the rollers 64 is formed by a relatively short length, hollow cylinder made of a rigid material, such as metal or hard plastic. The inner diameter of the rollers 64 is slightly larger than the outer diameter of the idler arm 62 (i.e. oversized) so that the rollers 64 rotate freely on the idler arm. If desired, the rollers 64 may be provided with an inner sleeve or insert made of a hard thermoplastic material having a relatively low coefficient of friction, such as Nylon or DuPont® Teflon®. The rollers 64 function to guide the ammunition belt 70 loaded with individual rounds of ammunition from the belt pulley 44 of the belt drive assembly 40 and through the housing 20 to the open upper end 23. The rollers 64 then guide the empty ammunition belt 70 from the upper end 23 of the housing 20 back to the belt pulley 44 of the belt drive assembly 40 at the open lower end 21.

In operation, the open-ended ammunition belt 70 is fed into the lower end 21 of the housing 20 such that the ammunition belt meshes with splines 45 on the belt pulley 44. The upper end 23 of the housing 20 of the loaded magazine 10 is then inserted into the magazine well 14 of the handgun 12. Movement of the slide of the handgun 12 in a conventional manner incrementally advances the ammunition belt 70 through the housing 20 in the following manner. As the slide moves forward within the handgun 12, it applies an impact force having a forward and/or downward component to the strike wheel 58 of the strike wheel and cam assembly 50. The force applied to the strike wheel 58 causes the cam 52 to pivot relative to the housing 20 and apply a downward force onto the timing adjuster cap 37 of the rack assembly 30, thereby compressing the spring 34. The downward force on the timing adjuster cap 37 in turn causes the rack 32 to move downwards towards the lower end 21 of the housing 20. As previously mentioned, the rack gear 38 at the lower end 31 of the rack 32 is meshed with the drive gear 46 of the belt drive assembly 40, preferably in a rack-and-pinion relationship. Thus, downward movement of the rack gear 38 causes the drive gear 46 to rotate freely in one direction (i.e. the slip direction) on the unidirectional bearing 48. When the slide is forced backward within the handgun 12 by the expending round of ammunition, the force applied to the strike wheel 58 is removed and the compressed spring 34 returns to its neutral position. As a result, the rack 32 moves upward and the rack gear 38 causes the drive gear 46 to rotate in the opposite direction (i.e. the drive direction) on the unidirectional bearing 48. Rotation of the drive gear 46 in the drive direction turns the drive axle 42, and consequently the splined belt pulley 44, to advance the ammunition belt 70 sufficiently to position the next round of ammunition for entry into the firing chamber of the handgun 12 when the slide once again moves forward.

Figure 9:
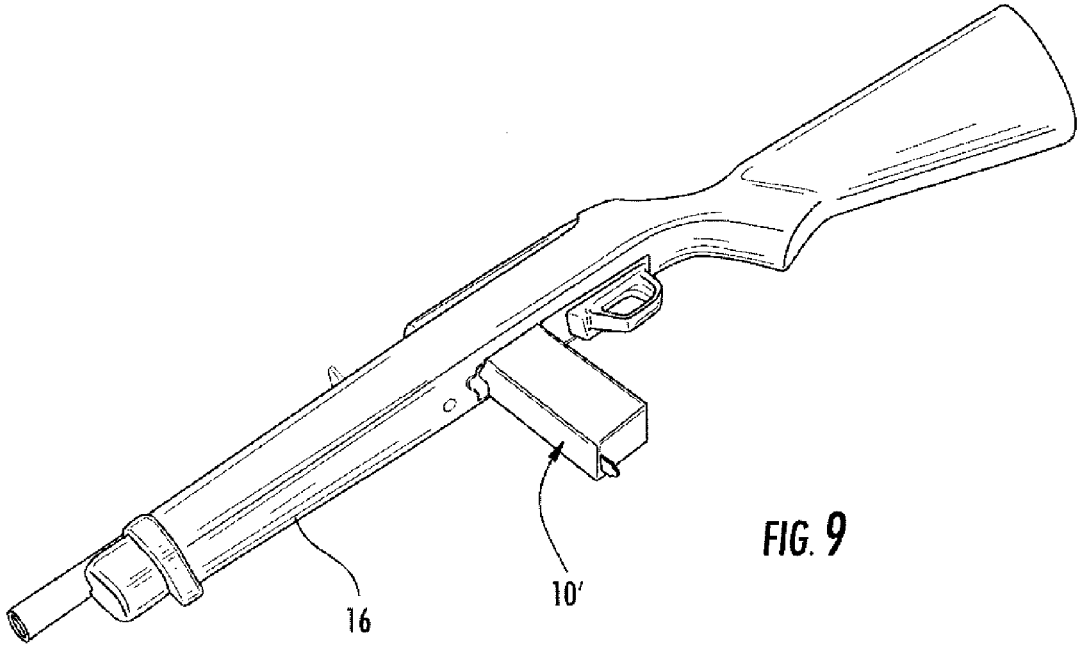
FIG. 9 is an environmental perspective view of an exemplary embodiment of a belt-fed magazine according to the present invention shown installed in a conventional 22 caliber firearm, namely a Ruger 10-22.
Figure 10:
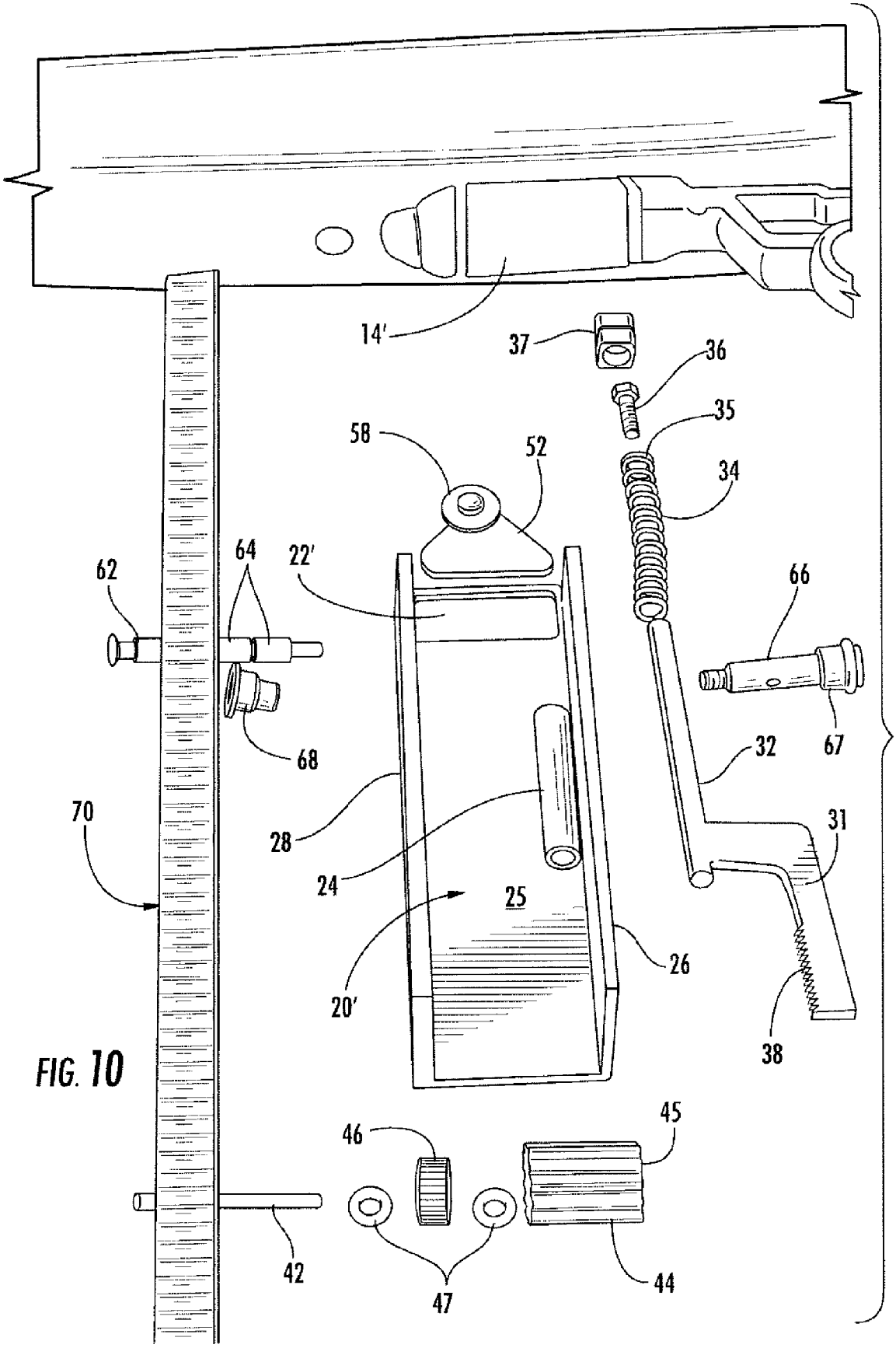
FIGS. 10-11 are exploded perspective views of the belt-fed magazine of FIG. 9 showing the magazine disassembled.
Figure 11:
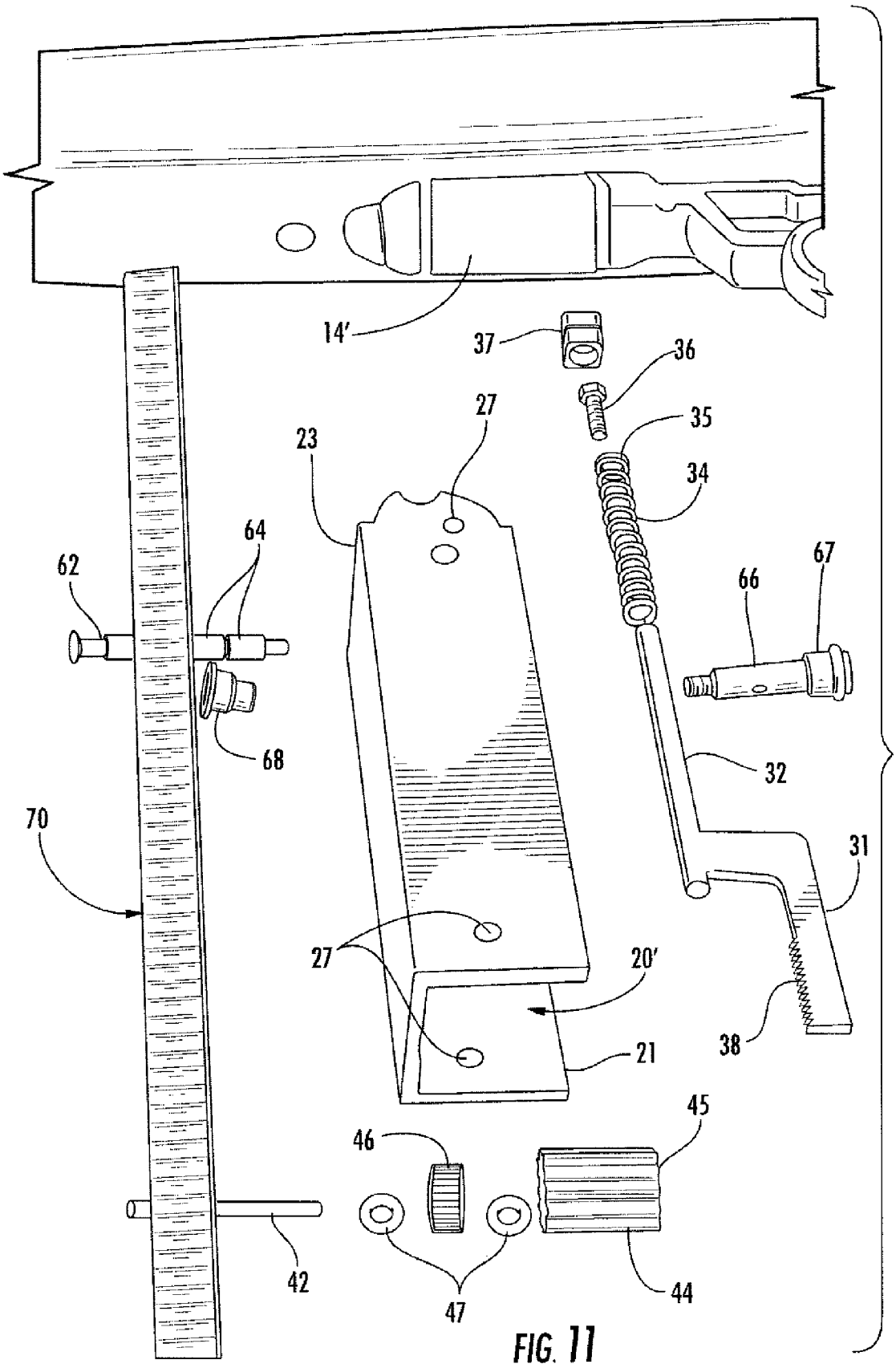
Figure 12:
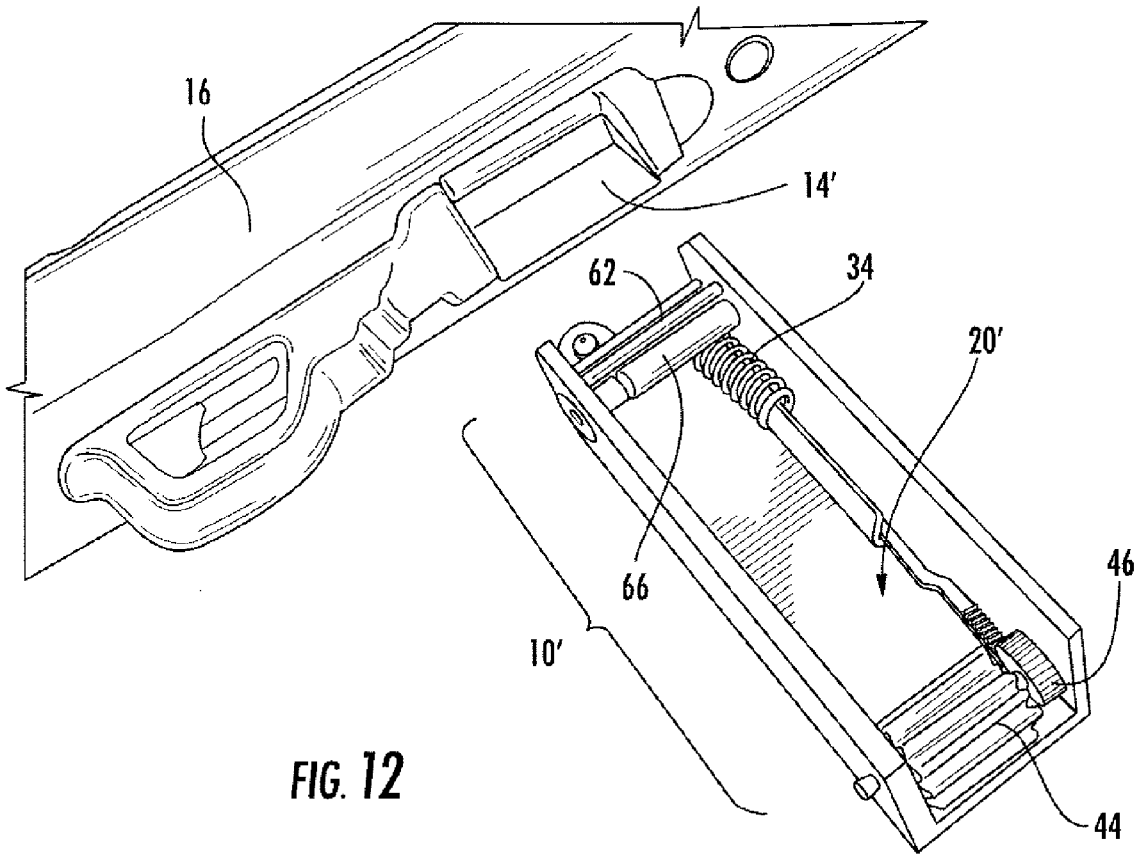
FIG. 12 is a perspective view of the belt-fed magazine of FIG. 9 showing the magazine assembled and with the ammunition belt removed for purposes of clarity.
Figure 13:
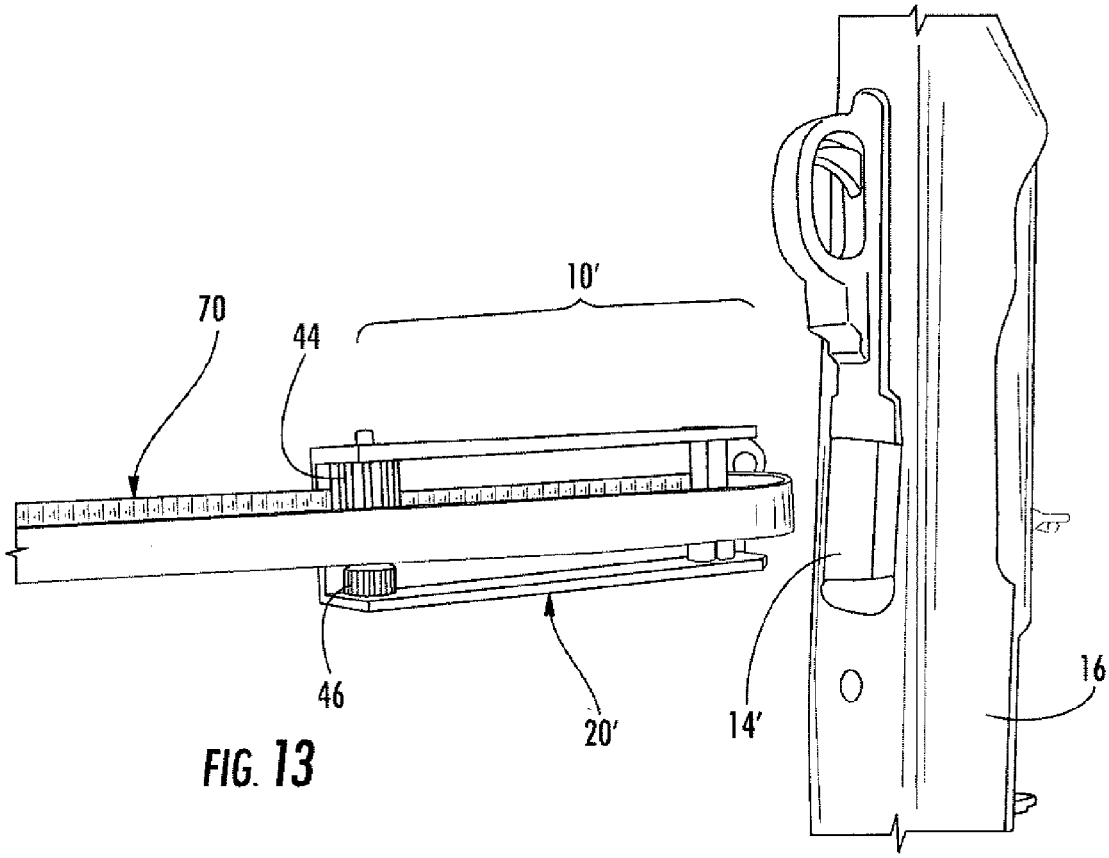
FIGS. 13-14 are perspective views of the belt-fed magazine of FIG. 9 showing the magazine fully assembled with the ammunition belt installed.
Figure 14:
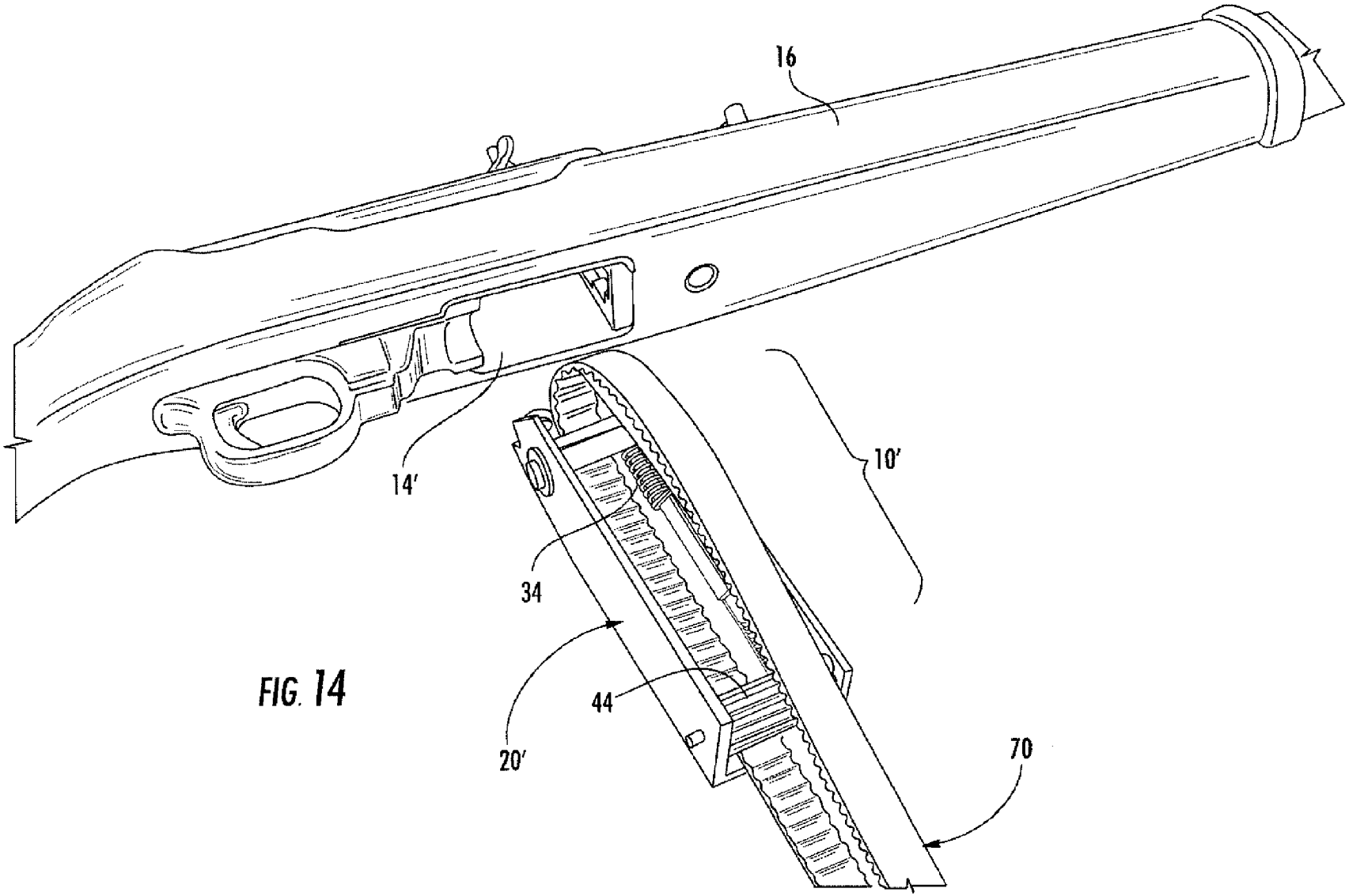
Figure 15:
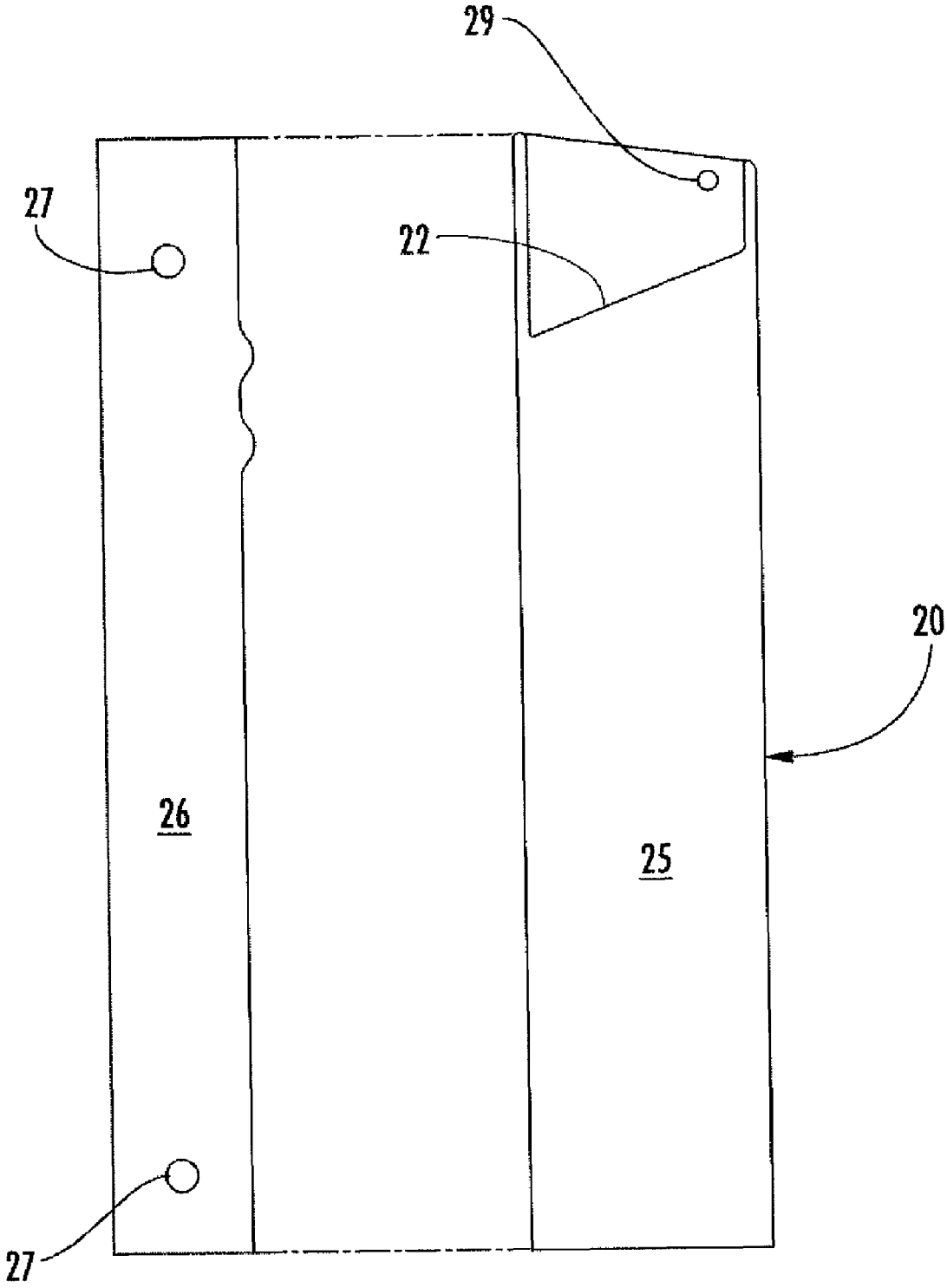
FIGS. 15-18 are schematic drawings showing details of the housing, the belt drive assembly, the strike wheel and cam assembly, and the roller idler assembly of the belt-fed magazine of FIG. 1.
Figure 16:
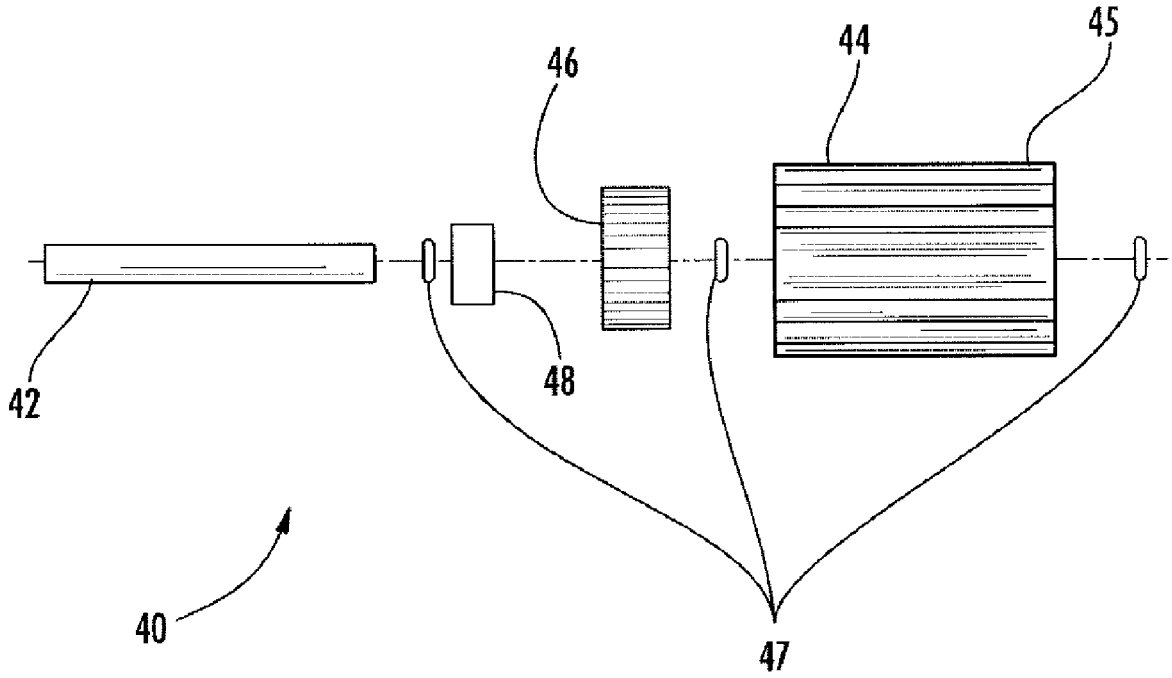

An alternative embodiment of a belt-fed magazine 10' according to the present invention is shown in FIG. 9. The magazine 10' is configured for use with a 22 caliber conversion kit for a rifle, such as an AR-15 or M-16, or with a non-converted 22 caliber firearm 16, such as a Ruger 10/22 or 10/77, having an enlarged magazine well 14' (FIG. 10). FIGS. 10-11 are exploded perspective views showing the magazine 10' disassembled. FIG. 12 is a perspective view showing the magazine 10' assembled and with the ammunition belt 70 removed for purposes of clarity. FIGS. 13-14 are perspective views showing the magazine 10' fully assembled with the ammunition belt 70 installed. The structure, function and operation of the magazine 10' is essentially the same as that of the magazine 10 shown in FIGS. 1-8 and FIGS. 15-18, which has been described in detail hereinabove. As a result, only the differences between the magazine 10' and the magazine 10 previously shown and described will be identified and discussed. Like reference numerals are utilized in FIGS. 9-14 for like parts in the corresponding FIGS. 1-8. Modified parts are indicated by primed reference numerals, and new or significantly different parts are indicated by new reference numerals.

It should be noted that the orientation of the magazine 10' relative to the rifle 16 is reversed as compared to the orientation of the magazine 10 relative to the handgun 12. The orientation is reversed due to the shell extractor being on the opposite side of the rifle 16. It should also be noted that a larger cutout 22' is required for the housing 20' of the magazine 10'. In addition, the roller idler assembly 60' is modified to include a threaded idler arm 66 having enlarged diameter outer surfaces 67, 68 at opposite ends in addition to the idler arm 62 and rollers 64 for guiding the ammunition belt 70. Other minor modifications may be necessary to the materials and/or dimensions of the magazine 10' in order to account for the enlarged magazine well 14' of the rifle 16. However, none of the required modifications is expected to materially alter the basic structure, function and operation of the magazine 10' as previously shown and described with respect to the magazine 10 configured for use with a handgun 12. Embodiments of the magazine 10 configured for use with a handgun 12 are described herein for use with commercially available rifle conversion kits that allow a pistol frame to be inserted into a rifle, such as the Mech Tech Pistol-To-Carbine Conversion Unit (CCU), as well as for other large caliber firearms that permit the use of a pistol magazine, such as the Kel-Tec SUB-2000 pistol-caliber rifle.

A belt-fed magazine 10 configured for use with a handgun 12 and a belt-fed magazine 10' configured for use with a rifle 16 (including a non-converted 22 caliber firearm having an enlarged magazine well 14') in accordance with the present invention provides a cost effective means of utilizing less expensive .22LR ammunition in a large caliber firearm. The magazine 10, 10' allows the user to substitute only the magazine of the 22 caliber conversion kit or non-converted 22 caliber firearm with no other alteration to the firearm. The magazine 10, 10' also provides relatively easy loading of .22LR ammunition and maintains the convenience of inserting and removing a magazine in a conventional manner (as opposed to other belt-fed ammunition systems). Furthermore, unlimited capacity and continuous feeding of .22LR ammunition is made possible by merely attaching open-ended ammunition belts 70 together. The magazine 10, 10' can also remain loaded with an ammunition belt 70 without adversely affecting the spring tension on the ammunition rounds, as occurs with conventional magazines configured for use with 22 caliber conversion kits for large caliber firearms, and conventional magazines configured for use with non-converted 22 caliber firearms.

The foregoing description of various embodiments of the invention is given here by way of example only. Although a belt-fed magazine for a 22 caliber conversion kit for a large caliber firearm or a non-converted 22 caliber firearm according to the present invention have been described with reference to preferred embodiments and examples thereof, other embodiments and examples may perform similar functions and/or achieve similar results. All such equivalent embodiments and examples are within the spirit and scope of the present invention and are intended to be covered by the appended claims. For example, some models of large caliber firearms may require the use of an external cam or lever to drive the rack assembly 30 in place of the strike wheel 58 described herein. In addition, the ammunition belt 70 may travel laterally through the housing 20 of the magazine 10, 10' below the magazine well 14, 14' and lay directly on the drive pulley 44. This embodiment of the magazine 10, 10' would be beneficial for use with large caliber firearms having limited internal space. The driving force for advancing the ammunition belt 70 would then be provided by the action of the bolt handle (i.e. cocking lever) of the firearm striking the external cam or lever each time the bolt handle cycles to the rear. This alternative embodiment would permit the use of an ammunition belt 70 in larger caliber (i.e. center fire) rifles as well as 22 caliber firearms.

That which is claimed is:

1. A magazine for delivering ammunition from an open-ended ammunition belt to a firearm having a magazine well, the magazine comprising:

a housing having at least one open end sized to be received within the magazine well of the firearm;

a rack assembly at least partially disposed within the housing;

a belt drive assembly at least partially disposed within the housing and operably coupled to a portion of the rack assembly;

a strike wheel and cam assembly at least partially disposed within the housing adjacent the open end and operably coupled to a portion of the rack assembly; and an idler roller assembly at least partially disposed within the housing adjacent the open end for guiding the ammunition belt through the housing, the idler roller assembly comprising an idler arm and at least one roller rotatably mounted on the idler arm;

wherein the strike wheel and cam assembly comprises a strike wheel and a cam that engages the rack assembly in response to a force applied to the strike wheel; and wherein the rack assembly engages the belt drive assembly to advance the ammunition belt through the housing to the magazine well of the firearm.

2. A magazine according to claim 1, wherein the belt drive assembly comprises:

a drive axle movably mounted on the housing;

a belt pulley fixed on the drive axle and configured for engaging the ammunition belt;

a drive gear mounted on the drive axle so as to rotate freely in one direction relative to the drive axle and to rotate with the drive axle in another direction.

3. A magazine according to claim 2, further comprising a unidirectional bearing disposed between the drive gear and the drive axle, the drive gear mounted on the unidirectional bearing such that the drive gear freely rotates on the unidirectional bearing in the one direction, but transfers torque to the unidirectional bearing in the other direction.

4. A magazine according to claim 2, wherein an outer surface of the belt pulley is provided with a plurality of circumferential, laterally-extending splines for engaging the ammunition belt.

5. A magazine according to claim 1, wherein the strike wheel and cam assembly comprises:

a cam movably mounted on the housing; and a strike wheel mounted on the cam.

6. A magazine according to claim 5, wherein the cam is generally triangular-shaped and comprises two shorter sides of substantially equal length and a longer side and wherein the strike wheel is rigidly affixed to the cam and the cam is pivotally attached to the housing such that the cam pivots relative to the housing when a force is applied to the strike wheel.

7. A magazine for delivering ammunition from an open-ended ammunition belt to a firearm having a magazine well, the magazine comprising:

a housing having at least one open end sized to be received within the magazine well of the firearm;

a rack assembly at least partially disposed within the housing;

a belt drive assembly at least partially disposed within the housing and operably coupled to a portion of the rack assembly; and a strike wheel and cam assembly at least partially disposed within the housing adjacent the open end and operably coupled to a portion of the rack assembly;

wherein the rack assembly comprises:

a rack having a lower end and an upper end, the lower end of the rack being provided with a rack gear for engaging the belt drive assembly;

a rack tube for receiving the rack and limiting movement of the rack to a predetermined linear direction relative to the housing;

a fastener disposed adjacent the upper end of the rack; and a spring captured between the rack tube and the fastener for retaining the spring on the rack.

8. A magazine according to claim 7 wherein the strike wheel and cam assembly engages the fastener to compress the spring from an elongated length to a compressed length to thereby bias the rack in the linear direction.

9. A magazine according to claim 7, wherein the fastener further comprises a timing adjuster cap and wherein the fastener functions as a timing adjuster for the magazine.

10. A belt-fed magazine for feeding an open-ended ammunition belt to a 22 caliber conversion kit or a non-converted 22 caliber firearm, the magazine comprising:

an essentially hollow, elongate, generally rectangular housing having at least one open end sized to be received within a magazine well of a firearm;

a rack assembly at least partially disposed within the housing, the rack assembly comprising:

a rack having a lower end and an upper end, the lower end of the rack being provided with a rack gear;

a rack tube for receiving the rack and limiting movement of the rack to a predetermined linear direction relative to the housing;

a fastener disposed adjacent the upper end of the rack; and a spring captured between the rack tube and the fastener for retaining the spring on the rack;

a belt drive assembly at least partially disposed within the housing; and a strike wheel and cam assembly at least partially disposed within the housing adjacent the open end;

wherein the strike wheel and cam assembly engages the rack assembly in response to a force from the firearm applied to the strike wheel and cam assembly and wherein the rack gear on the rack of the rack assembly engages the belt drive assembly to advance the ammunition belt through the housing to deliver ammunition to the firearm.

11. A belt-fed magazine according to claim 10, wherein the belt drive assembly comprises a drive axle rotatably attached to the housing, a belt pulley fixedly mounted on the drive axle, and a drive gear mounted on the drive axle so as to rotate freely relative to the drive axle in a first direction and to rotate with the drive axle in a second direction opposite to the first direction.

12. A belt-fed magazine according to claim 10, wherein the strike wheel and cam assembly comprises a strike wheel rigidly affixed to the cam and wherein the cam is pivotally attached to the housing so as to pivot relative to the housing when the force from the firearm is applied to the strike wheel.

13. A belt-fed magazine for feeding an open-ended ammunition belt to a firearm, the belt-fed magazine comprising:

an essentially hollow, elongate, generally rectangular housing having at least one open end sized to be received within a magazine well of a firearm;

a rack assembly at least partially disposed within the housing;

a belt drive assembly at least partially disposed within the housing;

a strike wheel and cam assembly at least partially disposed within the housing adjacent the open end; and an idler roller assembly at least partially disposed within the housing adjacent the open end for guiding the ammunition belt through the housing, the idler roller assembly comprising an idler arm and at least one roller rotatably mounted on the idler arm;

wherein the strike wheel and cam assembly engages the rack assembly in response to a force from the firearm applied to the strike wheel and cam assembly and wherein the rack assembly engages the belt drive assembly to advance the ammunition belt through the housing to deliver ammunition to the firearm.

14. In combination, a firearm and a magazine for delivering ammunition carried by an open-ended ammunition belt to a magazine well of the firearm, the magazine comprising a housing having at least one open end, a strike wheel movably disposed on the housing adjacent the open end and operable for receiving a force from the firearm, a biased rack at least partially disposed within the housing and movable relative to the housing within a rack tube as a result of the force from the firearm, and a belt pulley at least partially disposed within the housing and movable relative to the housing as a result of the movement of the rack for advancing the ammunition belt through the housing and thereby deliver the ammunition to the magazine well of the firearm.

15. The combination of claim 14, wherein the rack has an upper end and a lower end and a rack gear adjacent the lower end of the rack and wherein the rack is movable in a linear direction relative to the housing so to operably engage the rack gear with the belt pulley.

16. The combination of claim 14, wherein the belt pulley is fixed to a drive axle rotatably attached to the housing and wherein a drive gear is mounted on the drive axle so as to rotate freely relative to the drive axle in a first direction and to rotate with the drive axle in a second direction opposite to the first direction.

* * * * *